US005773189A

United States Patent [19]

Shibata

[11] Patent Number: 5,773,189

[45] Date of Patent: Jun. 30, 1998

[54] IMAGE FORMATION PROCESS

[75] Inventor: Takeshi Shibata, Kanagawa, Japan

[73] Assignee: Fuji Photo Film Co., Ltd., Kanagawa, Japan

[21] Appl. No.: 970,748

[22] Filed: Nov. 14, 1997

Related U.S. Application Data

[63] Continuation of Ser. No. 681,508, Jul. 23, 1996, abandoned.

[30] Foreign Application Priority Data

Jul. 25, 1995 [JP] Japan ..... 7-189189

[51] Int. Cl.[6] ..... G03C 8/40

[52] U.S. Cl. ..... 430/203; 430/349; 430/348; 430/353; 430/494

[58] Field of Search ..... 430/203, 348, 430/349, 353, 494

[56] References Cited

U.S. PATENT DOCUMENTS

| | | | |
|---|---|---|---|
| 4,503,137 | 3/1985 | Sawada | 430/203 |
| 4,740,445 | 4/1988 | Hirai et al. | 430/203 |
| 4,820,622 | 4/1989 | Hirai | 430/203 |
| 4,868,097 | 9/1989 | Aotsuka et al. | 430/203 |
| 5,049,473 | 9/1991 | Furuya et al. | 430/203 |
| 5,116,716 | 5/1992 | Komamura et al. | 430/203 |

FOREIGN PATENT DOCUMENTS

| | | | |
|---|---|---|---|
| 0121765 | 10/1984 | European Pat. Off. | 430/203 |
| 0210660 | 4/1987 | European Pat. Off. . | |
| A-8-122995 | 5/1996 | Japan . | |

*Primary Examiner*—Richard L. Schilling
*Attorney, Agent, or Firm*—Sughrue, Mion, Zinn, Macpeak & Seas, PLLC

[57] ABSTRACT

An image formation process comprising image exposing a photosensitive element which contains at least a photosensitive silver halide, a binder and a dye donating compound which forms or releases a diffusive dye corresponding or inversely corresponding to an exposure amount, and transferring the diffusive dye formed or released to a dye fixing element by heat development in the presence of a base and/or a precursor thereof, wherein the process further comprises the step of feeding water to said photosensitive element after image exposure, and the photosensitive element is maintained at a temperature of 40° to 90° on undergoing exposure, whereby photographic performance of the heat development photosensitive material exhibits good stability to changes in ambient temperature on undergoing exposure.

3 Claims, No Drawings

IMAGE FORMATION PROCESS

This is a continuation of application Ser. No. 08/681,506 filed Jul. 23, 1996, now abandoned.

FIELD OF THE INVENTION

The present invention relates to an image formation process using a heat development color photosensitive element, and particularly, to an image formation process which exhibits satisfactory stability to changes in ambient temperature.

BACKGROUND OF THE INVENTION

Heat development photosensitive materials have known in this technological field. The heat development photosensitive materials and the processes are described, for example, in *SHASHIN-KOGAKU NO KISO; HIGIN-EN SHASHIN* (*Basis for Photographic Engineering; Nonsilver Photography*), Corona Publishing Co., Ltd., pp. 242 to 255 (1982).

Many processes for forming color images by heat development have also been proposed. For example, a process for forming color images by binding oxidation products of developing agents to couplers is described in U.S. Pat. Nos. 3,531,286, 3,761,270 and 4,021,240, Belgian Patent 802, 519, *Research Disclosure* (hereinafter abbreviated as "RD"), September, 1975, pp. 31 to 32, and so forth.

However, the above-mentioned heat development photosensitive materials forming color images are of a non-fixing type, and therefore, silver halide remaining on the materials after image formation causes a serious disadvantage in that exposure to strong light or prolonged storage gradually discolors the white backgrounds of the materials. Further, the above-mentioned processes suffer from the disadvantages in that development requires a relatively long time and that images formed have high fog and low image density in general.

To overcome these drawbacks, a process for transferring a diffusive dye formed or released in an image form to an image receiving material containing a mordant by heating by use of a solvent such as water is described in U.S. Pat. Nos. 4,500,626, 4,483,914, 4,503,137, and 4,559,920, JP-A-59-165054 (The term "JP-A" as used herein means an "unexamined published Japanese patent application"), and so forth.

The above-mentioned process is not still satisfactory because of high development temperature and insufficient aging stability of a photosensitive material. Therefore, to promote the development, lower the development temperature and simplify processing, a process for transferring the dye by heat development in the presence of a base or a precursor thereof and a small amount of water is disclosed in JP-A-59-218443, JP-A-61-238056, European Patent 210, 660A2, and so forth.

Many processes for forming positive color images have also been proposed. U.S. Pat. No. 4,559,290 proposes a process for releasing a diffusive dye by use of a photosensitive material containing an oxidation product of a so-called "DRR compound" and a reducing agent or a precursor thereof, the oxidation product itself having no ability to release a dye, in which the reducing agent is oxidizing depending upon an amount of exposed silver halides on heat development and the reducing agent remaining unoxidized reduces the oxidation product to release the diffusive dye. Further, a heat development color photosensitive material releasing a diffusive compound in a similar mechanism is described in U.S. Pat. No. 4,783,396 and JP-A-64-13546. That is, the photosensitive material contains a nondiffusive compound which releases a diffusive compound by reductive cleavage of an N—X bond (X represents an oxygen atom, a nitrogen atom, or a sulfur atom). In this process, the photosensitive material having a multilayer structure, which contains on a support at least a photosensitive silver halide, a binder, an electron donor and/or a precursor thereof (preferably nondiffusive), and the nondiffusive compound releasing the diffusive dye by reduction thereof, is exposed, and then heated so that the electron donor is oxidized depending upon an amount of the silver halide and the above-mentioned nondiffusive dye-donating compound is reduced by the electron donor remaining unoxidized, thus releasing the diffusive dye which is transferred to a dye fixing material containing a mordant to form a positive color image.

The following embodiment is described in the specifications cited above. That is, a photosensitive material contains a sparingly water-soluble metallic compound, whereas a dye fixing material contains a compound which releases a base by a complex formation reaction with the above-mentioned sparingly water-soluble metallic compound in water as a medium (hereinafter referred to as a "complex forming compound"). After water is fed to the photosensitive material exposed, the photosensitive material is superposed upon the dye fixing material, and heated to form an image.

However, the stability of the image density by the above-mentioned process is not still satisfactory, because changes in ambient temperature cause fluctuations in density on output of the image. Further the process has also a disadvantage of generating fluctuations in image density.

SUMMARY OF THE INVENTION

An object of the present invention is to provide an image formation process in which photographic performance exhibits satisfactory stability to the changes in ambient temperature.

As a result of an intensive investigation undertaken to solve the above-mentioned problems, the present inventors have found that the object can be attained by the following image formation process: an image formation process comprising image exposing a photosensitive element which contains at least a photosensitive silver halide, a binder and a dye donating compound forming or releasing a diffusive dye corresponding or inversely corresponding to an exposure amount, and transferring the diffusive dye formed or released to a dye fixing element by heat development in the presence of a base and/or a precursor thereof, wherein the process further comprises the step of feeding water to said photosensitive element after image exposure and the temperature of the photosensitive element is maintained at 40° to 90° C. on undergoing exposure.

DETAILED DESCRIPTION OF THE INVENTION

The present inventors have found that the fluctuations in density depending upon changes in ambient temperature on output of images are caused by changes in ambient temperature on exposure, and also that the fluctuations in image density are caused by uneven feeding of water to a photosensitive element.

Further, the present inventors have discovered that the fluctuations in density depending upon changes in ambient temperature on exposure are solved by heating the photosensitive element to a constant temperature within the range of 40° to 90° C. on undergoing exposure, and that the fluctuations in amount of absorbed water are improved by heating the photosensitive element to 40° to 90° C. prior to the feeding of water to the photosensitive element.

Improvement in fluctuations in amount of absorbed water is more promoted by feeding water to the photosensitive element immediately after heating. The feeding of water is conducted within 5 minutes, and preferably within 1 minute after heating. The fluctuations in amount of absorbed water are presumed to refer to wettability of the membrane surface of the photosensitive element by water, although the mechanism is not clear.

As described above, the present inventors have found that both the fluctuations in density and in image density can be simultaneously improved by heating the photosensitive element to a constant temperature within the range of 40° to 90° C. on exposure. Heating is conducted so that the photosensitive element can be maintained at a constant temperature within the range of 40° to 90° C. during exposure. The constant temperature herein means maintaining a preset temperature within the range of ±5° C., and particularly within the range of ±3° C.

The means of heating the photosensitive element is not particularly limited. The heating of the photosensitive element is conducted, for example, by passing it through between 2 hot plates, by bringing it into contact with a hot plate, by bringing it into contact with a revolving hot drum or roller, by passing it through hot air, or by transporting it along heat sources with the aid of rollers, a belt, or guide members.

In view of miniaturization of equipment and power saving, it is preferred that the same temperature and the same heater as those in the heat development are used for the heating.

In the present invention, methods for feeding water to the photosensitive material are not particularly limited. For example, a water feeding chamber is placed in the upstream side of the heat development stage toward the direction of a transported photosensitive material, and water maintained at a certain temperature is fed to the surface of the material. The feeding of water in the chamber is carried out in the following manner. For example, the photosensitive material is dipped in water in a shallow vessel for a certain time, and excess water is then removed from the surface of the material by use of squeeze rolls or the like. Or the surface of the photosensitive material is pressed against the leading edge of felt projected from the above-mentioned vessel to apply water to the surface, and excess water is then removed from the surface of the material by use of squeeze rolls or the like. Further, a slit formed in a pipe and the photosensitive material are arranged oppositely, and the material is transported so as to almost come in contact with the slit, thus coating the material with water which is maintained at a certain temperature and extruded from the slit. Various forms are possible also in the method for removing excess water by use of squeeze rolls after water is applied by these methods (JP-A-62-212653, JP-A-62-929558, JP-A-4-275551, JP-A-4-275550, JP-A-4-43350, JP-A-3-294855, JP-A-3-110559, and so forth).

In addition to the above-mentioned components, organic metal salt oxidizing agents can be added, as needed, to the heat development photosensitive element (hereinafter occasionally referred to as the "photosensitive material). These components are often added to the same layer. However, when a combination of some components is reactive, these components can be separately contained in different layers. For example, a colored reducible dye donating compound is preferably contained in the lower layer next to a silver halide emulsion layer to prevent sensitivity from decreasing. Although an electron transfer agent is preferably incorporated into the heat development photosensitive material, the agents may be fed externally, for example, by a method of diffusing the agents from a dye fixing element described later.

In the present invention, the amount of water fed is an amount of water required to transfer a diffusive dye image to a dye fixing element by heat development in the presence of water, and varies depending upon amounts of gelatin applied to the heat development color photosensitive material and the dye fixing element. The amount of water fed ranges from 1 to 40 g/m$^2$, preferably from 3 to 30 g/m$^2$, and more preferably from 6 to 25 g/m$^2$.

In the present invention, arrangements of a blue sensitive emulsion layer, a green sensitive emulsion layer and a red sensitive emulsion layer are conducted in arbitrary order, and various arrangements known for customary color photosensitive materials can be adopted. The respective sensitive layers may be divided into 2 or more layers, as needed, as described in JP-A-1-252954 and so forth.

Various auxiliary layers such as a protective layer, a undercoat layer, an interlayer, an yellow filter layer, an antihalation layer, and a backing layer can be provided on the heat development photosensitive material.

When a support is paper laminated with polyethylene containing a white pigment such as titanium oxide, the backing layer thereof is preferably designed so as to possess an antistatic function in which the surface resistivity is $10^{12}$ Ω-cm or less.

Photosensitive silver halides usable for the respective sensitive layers of the present invention may be any of silver chloride, silver bromide, silver iodobromide, silver chlorobromide, silver chloroiodide, and silver chloroiodobromide. Silver halide emulsions used may be either surface latent image type emulsions or internal latent image type emulsions. The internal latent image type emulsions are used as direct reversal emulsions by use of a nucleating agent or a combination thereof with a light fogging agent. Further, the so-called "core shell emulsions" may be used, in which internal portions of grains have a phase different from surface layers of grains. The silver halide emulsions may be either monodispersions or polydispersions, and further mixtures of the monodispersions may be used. Particularly, a method of mixing emulsions having different sensitivity is preferably used to adjust gradation (for example, JP-A-1-167744). The grain sizes are preferably from 0.1 to 2 μm, and more preferably from 0.2 to 1.5 μm. The crystal habit of the silver halide grains used may be any of cube, octahedron, tetradecahedron, tabular crystals having high aspect ratios, and others.

The photosensitive silver halide emulsions used in the present invention are preferably core shell emulsions. The monodispersion emulsions having coefficients of variation of 20% or less are preferred, which are described in JP-A-3-110555.

Any of silver halide emulsions described in U.S. Pat. Nos. 4,500,626 (column 50) and 4,628,021, *Research Disclosure* (hereinafter abbreviated as "RD"), 17029 (1978), JP-A-62-253159, JP-A-3-110555, JP-A-2-236546, JP-A-1-167743, and so forth can be used in the present invention.

In the process of the adjustment of the photosensitive silver halide emulsions of the present invention, the so-called "salt removal" to remove excess salts is preferably carried out. Means of the salt removal include a noodle washing method which is applied to a gel of gelatin and a sedimentation method for which inorganic salts consisting of polyvalent anions (for example, sodium sulfate), anionic surfactants, anionic polymers (for example, sodium polystyrenesulfate), or gelatin derivatives (for example, aliphatic acylated gelatin, aromatic acylated gelatin, or aromatic carbamoylated gelatin) are utilized. The sedimentation method is preferably used.

To the photosensitive silver halide emulsions used in the present invention, compounds of heavy metals such as iridium, rhodium, platinum, cadmium, zinc, thallium, lead, iron, and osmium may be added for various purposes. These compounds may be used singly or as mixtures of 2 or more kinds thereof. The contents of the compounds are generally from about $10^{-9}$ to about $10^{-3}$ mole per mole of silver halide, although the contents vary with the purpose of use. The compounds may be uniformly contained in grains, or may be located in the internal portions of grains or on the surfaces thereof. Examples of the emulsions used preferably are described in JP-A-2-236542, JP-A-1-116637, JP-A-5-181246, and so forth.

In the grain formation step of the photosensitive silver halide emulsions in the present invention, rhodanates, ammonia, tetra-substituted thioether compounds, organic thioether derivatives described in JP-B-47-11386 (The term "JP-B" as used herein means an "examined Japanese patent publication"), or sulfur-containing compounds described in JP-A-53-144319 can be used as solvents for silver halides.

The other conditions are available in P. Glafkides, *Chimie et Phisigue Photographigue,* Paul Montel, 1967; G. F. Duffin, *Photographic Emulsion Chemistry,* The Focal Press, 1966; V. L. Zelikman et al., *Making and Coating Photographic Emulsion,* The Focal Press, 1964; and so forth. That is, any of an acidic process, a neutral process and an ammonia process can be employed, and to react a soluble silver salt with a soluble halide salt, any of a single jet mixing process, a double jet mixing process and a combination thereof may be used. To obtain monodispersion emulsions, the double jet mixing process is preferably used. A reversed mixing process for forming grains in the presence of excess silver ion can also be used. A so-called "control double jet process", a type of the double jet mixing process, can also be used, in which pAg of the solution where silver halides are being formed is kept constant.

To promote grain growth, the concentrations of a silver salt and a halide salt added, the amount thereof, and the addition speed may be increased (JP-A-55-142329, JP-A-55-158124, U.S. Pat. No. 3,650,757, and so forth).

Any of known agitation methods can be employed to stir the reaction mixture. During the formation of silver halide grains, the temperatures and pH of the reaction mixture can be freely set as needed. The pH ranges preferably from 2.2 to 7.0, and more preferably from 2.5 to 6.0.

The photosensitive silver halide emulsions are those which have been subjected to chemical sensitization in general. In the present invention, known processes of chemical sensitization such as sulfur sensitization, reduction sensitization, noble metal sensitization, and selenium sensitization which are used for emulsions of customary photosensitive materials can be used singly or in the combinations thereof (for example, JP-A-3-110555 and JP-A-5-241267). The above-mentioned chemical sensitization can also be carried out in the presence of nitrogen-containing heterocyclic compounds (JP-A-62-253159). On undergoing the chemical sensitization, the pH of the reaction mixture is preferably from 5.3 to 10.5, and more preferably from 5.5 to 8.5, and the pAg thereof is preferably from 6.0 to 10.5, and more preferably from 6.8 to 9.0.

In the present invention, the coating amounts of the photosensitive silver halide emulsions range from 1 $mg/m^2$ to 10 $g/m^2$, based on amounts converted to silver.

To give color sensitivity to green and red to the photosensitive silver halides used in the present invention, the photosensitive silver halide emulsions are subjected to spectral sensitization by use of methine dyes and the like. Further, the blue sensitive emulsion may undergo spectral sensitization in the blue region as needed.

Dyes used for this purpose are cyanine dyes, merocyanine dyes, composite cyanine dyes, composite merocyanine dyes, holopolar cyanine dyes, hemicyanine dyes, styryl dyes, and hemioxonol dyes. Examples of these sensitizing dyes are described in U.S. Pat. No. 4,617,257, JP-A- 59-180550, JP-A-60-140335, RD 17029, 1978, PP. 12 to 13. These sensitizing dyes may be used singly or as mixtures thereof. Particularly, the mixtures are often used for the purpose of supersensitization. Compounds exhibiting the supersensitization which themselves have no effect of spectral sensitization or do not substantially absorb visible rays may also be added to the emulsions together with the sensitizing dyes (for example, compounds described in U.S. Pat. No. 3,615,641, JP-A-63-23145, and so forth).

These sensitizing dyes may be added to the emulsions on chemical ripening, before or after the chemical ripening, or before or after nucleation of the silver halide grains as described in U.S. Pat. Nos. 4,183,756 and 4,225,666. The amounts of the sensitizing dyes to be added are generally from about $10^{-8}$ to about $10^{-2}$ mole per mole of silver halide.

A chemically unsensitized silver halide emulsion used in the present invention is added to at least one layer of the above-mentioned blue sensitive silver halide emulsion, green sensitive silver halide emulsion and red sensitive silver halide emulsion. Particularly, in the present invention the chemically unsensitized silver halide emulsion is preferably added to the green sensitive silver halide emulsion layer to markedly improve color reproduction, stability of the white background and aging stability. It has been quite unexpected that the above-mentioned effects are produced by the addition of the chemically unsensitized silver halide emulsion which is not contributed to the sensitivity, although the mechanism of improvement in color reproduction and aging stability is not clear.

Silver chlorobromide or silver chloroiodobromide having an average grain size of 0.3 $\mu$m or less and a silver chloride content of 50% or more is employed for the chemically unsensitized silver halide emulsion. The grain size of 0.2 $\mu$m or less and silver chlorobromide having a silver chloride content of 60% or more are preferred.

The preparation of the chemically unsensitized silver halide emulsion used in the present invention is carried out in a similar manner to that of the above-mentioned photosensitive silver halide emulsions, except that the chemically unsensitized silver halide emulsion is not subjected to the chemical sensitization.

The chemically unsensitized silver chlorobromide or silver chloroiodobromide emulsion used in the present invention which has an average grain size of 0.3 $\mu$m or less and a silver chloride content of 50% or more is not substantially photosensitive.

The content of the chemically unsensitized silver halide emulsion in amount of silver is preferably 30% or less, and more preferably 20% or less, based on the green sensitive silver halide emulsion.

Gelatin is advantageously used as a protective colloid in the preparation of the emulsions of the present invention and as a binder for constituent layers of the photosensitive material and the dye fixing element. However, hydrophilic binders other than gelatin can also be used. Examples thereof are described in JP-A-62-253159, pp. 26 to 28. Specifically, transparent or translucent hydrophilic binders are preferably used. Examples thereof include natural compounds such as proteins (for example, gelatin and gelatin derivatives) and polysaccharides (for example, cellulose derivatives, starch, gum arabic, dextran, and pullulan); and synthetic polymers such as polyvinyl alcohol, polyvinyl pyrrolidone and polyacrylamide. Further, high water-absorptive polymers described in JP-A-62-245260, that is, homopolymers prepared from vinyl monomer containing a —COOM group or a —$SO_3M$ group (M represents a hydrogen atom or an alkali metal), copolymers prepared from these vinyl monomers, or copolymers prepared from the vinyl monomers and other vinyl monomers, (for example, sodium methacrylate, ammonium methacrylate and Sumikagel L-5H manufactured by Sumitomo Chemical Co., Ltd.) are also used. These binders can also be used as mixtures of 2 or more kinds thereof.

When a system conducting heat development by feeding a small amount of water is adopted, use of the above-mentioned high water-absorptive polymers makes rapid absorption of water possible. Further, the high water-absorptive polymers used for the dye fixing layer or its protective layer protect transferred dyes from being retransferred from the dye fixing element to others.

In the present invention, the coating amounts of the binders are preferably 20 g/$m^2$ or less, more preferably 10 g/$m^2$ or less, and most preferably 7 g/$m^2$ or less.

In the present invention, organic metal salts can be used as oxidizing agents together with the photosensitive silver halides. Organic silver salts are particularly preferably used among the organic metal salts. Organic compounds usable for forming the organic silver salt oxidizing agents include benzotriazoles described in U.S. Pat. No. 4,500,626, (columns 52 to 53), fatty acids, and other compounds. Silver salts of carboxylic acids containing alkynyl groups such as silver phenylpropiolate described in JP-A-60-113235 and silver acetylide described in JP-A-61-249044 are also useful. These organic silver salts may be used as mixtures of 2 or more kinds thereof.

The contents of these organic silver salts are from 0.01 to 10 moles, and preferably from 0.01 to 1 mole per mole of the photosensitive silver halides. The total coating amounts of the photosensitive silver halides and the organic silver salts are suitably from 50 mg/$M^2$ to 10 g/$m^2$ in amounts converted to silver.

In the present invention, various antifoggants or photographic stabilizers can be used. Examples thereof include azoles or azaindenes described in RD 17643, 1978, pp. 24 to 25, nitrogen-containing carboxylic acids and phosphoric acids described in JP-A-59-168442, mercapto compounds and metal salts thereof described in JP-A-59-111636 and JP-A-4-73649, and acetylene compounds described in JP-A-62-87957 and JP-A-4-255845.

To the constituent layers (including backing layers) of the photosensitive material and the dye fixing element, various polymer latexes can be added to improve physical properties of the films such as dimensional stability, curling prevention, adhesion prevention, film cracking prevention, and pressure induced sensitivity modification immunity. Any of polymer latexes described in JP-A-62-245258, JP-A-62-136648, JP-A-62-110066, and so forth can be used for this purpose. Especially, polymer latexes having low glass transition points (40° C. or less) used for a mordant layer can prevent the mordant layer from cracking. Further, polymer latexes having high glass transition points used for a backing layer have the effect of curling prevention.

The electron donors used in the present invention are ones known in the field of the heat development photosensitive materials. Precursors of reducing agents can also be used, which themselves have no reducibility but generate the reducibility by the action of nucleophilic reagents or heat in the process of development.

Examples of the electron donors and precursors thereof used in the present invention are described in U.S. Pat. Nos. 4,500,626 (columns 49 to 50), 4,483,914 (columns 30 to 31), 4,330,617, and 4,590,152, JP-A-60-140335 (PP. 17 to 18), JP-A-57-40245, JP-A-56-138736, JP-A-59-178458, JP-A-59-53831, JP-A-59-182449, JP-A-59-182450, JP-A-60-119555, JP-A-60-128436 to 60-128439, JP-A-60-198540, JP-A-181742, JP-A-61-259253, JP-A-62-244044, JP-A-62-131253 to 62-131256, and European Patent 220,746A2 (pp. 78 to 96). Various combinations of electron donors as disclosed in U.S. Pat. No. 3,039,869 can also be used.

The electron transfer agents or precursors thereof can be selected among the above-mentioned electron donors and precursors thereof. The electron transfer agents or precursors thereof are desired to have mobilities larger than the non-diffusive electron donors. Particularly useful electron transfer agents are 1-phenyl-3-pyrazolidones and aminophenols.

The nondiffusive electron donors used in combination with the electron transfer agents may be selected among the above-mentioned reducing agents which do not substantially move in the layers of the photosensitive material. Hydroquinones, sulfonamidophenols, sulfonamidonaphthols, and compounds described as electron donors in JP-A-53-110827 are preferably employed.

In the present invention, the total contents of the electron donors and the electron transfer agents are from 0.01 to 20 moles, and more preferably from 0.1 to 10 moles per mole of silver.

The dye donating substances used in the present invention are compounds which form or release mobile dyes inversely corresponding to a reaction in which silver ion is reduced to silver in the conditions of high temperature.

The dye donating compounds include compounds which have a function to release or diffuse the diffusive dyes in image forms. The compounds of this type can be represented by the following general formula (LI):

$$(\text{Dye-Y})_n\text{—Z} \qquad \text{(LI)}$$

wherein Dye represents a dye group, a dye group or a precursor group thereof which temporarily absorbs rays having shorter wavelengths; Y represents a mere bond or a linking group; Z represents a group possessing a property that a difference arises in diffusivity of the compounds represented by formula (LI) corresponding or inversely corresponding to the photosensitive silver salts having latent images in image forms, or that a difference in diffusivity arises between released Dye and $(\text{Dye-Y})_n$–Z; and n represents 1 or 2, and when n is 2, the two Dye-Y groups may be the same or different.

Examples of the dye donating compounds represented by general formula (LI) include compounds described in the following paragraphs (1) to (3), with the proviso that the compounds described in the following paragraphs (1) to (3) form images of the diffusive dyes inversely corresponding to the development of silver halides (positive dye images).

(1) Dye developers formed by linking hydroquinone type developers to dye components, which are described in U.S. Pat. Nos. 3,134,764, 3,362,819, 3,597,200, 3,544, 545, 3,482,972, and so forth. Although these dye developers exhibit diffusivity under alkaline circumstances, they become nondiffusive by reacting with silver halides.

(2) Nondiffusive compounds which release diffusive dyes under alkaline circumstances but lose the ability by reacting with silver halides as described in U.S. Pat. No. 4,503,137 and so forth. Examples thereof include compounds which release diffusive dyes by an intramolecular nucleophilic displacement reaction as described in U.S. Pat. No. 3,980,479 and so forth; and compounds which release diffusive dyes by an intramolecular rearrangement reaction of isooxazolone rings as described in U.S. Pat. No. 4,199,354 and so forth.

(3) Nondiffusive compounds which release diffusive dyes by reacting with reducing agents remaining unoxidized on development, as described in U.S. Pat. No. 4,559, 290, European Patent 220,746A2, U.S. Pat. No. 4,783, 396, *Kokai Giho* (*Journal of Technical Disclosure*) 87-6199, and so forth. Examples thereof include compounds which release diffusive dyes by an intramolecular nucleophilic displacement reaction after undergoing reduction as described in U.S. Pat. Nos. 4,139,389 and 4,139,379, JP-A-59-185333, JP-A-57-84453, and so forth; compounds which release diffusive dyes by an intramolecular electron transfer reaction after undergoing reduction as described in U.S. Pat. No. 4,232,107, JP-A-59-101649, JP-A-61-88257, RD 24025, 1984, and so forth; compounds which release diffusive dyes by cleavage of single bonds after undergoing reduction as described in West German Patent 3,008,588A, JP-A-56-142530, U.S. Pat. Nos. 4,343,893 and 4,619,884, and so forth; nitro compounds which release diffusive dyes after accepting electrons as described in U.S. Pat. No. 4,450,223 and so forth; and compounds which release diffusive dyes after accepting electrons as described in U.S. Pat. No. 4,609,610 and so forth.

Examples of the dye donating compounds used more preferably include compounds which contain N—X bonds (X represents an oxygen atom, a sulfur atom, or a nitrogen atom) and electron attracting groups in molecule as described in European Patent 220,746A2, *Journal of Technical Disclosure* 87-6199, U.S. Pat. No. 4,783,396, JP-A-63-201653, JP-A-63-201654, and so forth; compounds which contain $SO_2$—X bonds (X has the same meanings as above) and electron attracting groups in molecule as described in JP-A-1-26842; compounds which contain PO—X bonds (X has the same meanings as above) and electron attracting groups in molecule as described in JP-A-63-271344; and compounds which contain C—X' bonds (X' has the same meanings as for X above or represents a —$SO_2$— group) and electron attracting groups in molecule as described in JP-A-63-271341. Further, compounds which release diffusive dyes by single bond cleavage after being reduced by n bonds conjugated with electron accepting groups as described in JP-A-1-161237 and JP-A-1-161342 can also be employed.

The compounds containing N—X bonds and electron attracting groups in molecule are preferably used among the above compounds. Examples thereof include compounds (1) to (3), (7) to (10), (12), (13), (15), (23) to (26), (31), (32), (35), (36), (40), (41), (44), (53) to (59), (64), and (70) described in European Patent 220,746A2 or U.S. Pat. No. 4,783,396; compounds (11) to (23) described in *Journal of Technical Disclosure* 87-6199.

In the present invention, redox compounds releasing development inhibitors can be used as described above. Such compounds are described, for example, in JP-A-61-213847, JP-A-62-260153, JP-A-2-68547, JP-A-2-110557, JP-A-2-253253, and JP-A-1-150135. Processes for the preparation of the redox compounds releasing the development inhibitors used in the present invention are described, for example, in JP-A-61-213847, JP-A-62-260153, U.S. Patent 4,684,604, JP-A-1-269936, U.S. Pat. Nos. 3,379,529, 3,620,746, 4,377,634, and 4,332,878, JP-A-49-129536, JP-A-56-153336, JP-A-56-153342, and so forth.

In the present invention, the contents of the redox compounds releasing the development inhibitors preferably range from $1\times10^{-6}$ to $5\times10^{-2}$ mole, and more preferably from $1\times10^{-5}$ to $1\times10^{-2}$ mole per mole of silver halides. Prior to use, the redox compounds releasing the development inhibitors used in the present invention are dissolved in suitable water-miscible organic solvents such as alcohols (for example, methanol, ethanol, propanol, and fluorinated alcohols), ketones (for example, acetone and methyl ethyl ketone), dimethylformamide, dimethylsulfoxide, and methyl cellosolve. Further, to use the redox compounds releasing the development inhibitors, the redox compounds are dissolved in oils such as dibutyl phthalate, tricresyl phosphate, glycelyl triacetate, and diethyl phthalate, or cosolvents such as ethyl acetate and cyclohexane, and then, emulsified dispersions thereof are mechanically prepared by well-known emulsification-dispersion processes. Or powdered redox compounds releasing the development inhibitors are dispersed in water by known solid state dispersion processes using a ball mill, a colloid mill, or a ultrasonic wave.

One or more kinds of dextran, pullulan, and derivatives thereof may be added to the heat development color photosensitive material of the present invention. Dextran and pullulan each are one kind of polysaccharides and polymers of D-glucose. The molecular weights of dextran used in the present invention are preferably from 20,000 to 2,000,000, and more preferably from 100,000 to 800,000. The molecular weights of pullulan used are preferably from 20,000 to 2,000,000.

Although dextran, pullulan, or the derivatives thereof may be contained in any layers of the heat development photosensitive material, it is preferred that they are contained in the interlayer and the protective layer. The coating amounts of dextran, pullulan, and/or the derivatives thereof range from 0.01 to 10 g/m$^2$, and preferably from 0.05 to 5 g/m$^2$. The coating amounts less than 0.01 g/m$^2$ fail to offer effect of the present invention, whereas the coating amounts exceeding 10 g/m$^2$ result in deterioration in film quality.

Hydrophobic additives such as the dye donating compounds, the nondiffusive reducing agents and the electron donors can be introduced to the layers of the photosensitive material by known methods as described in U.S. Pat. No. 2,322,027. In this case, high boiling organic solvents can be used, as needed, together with low boiling organic solvents having boiling points of 50° to 160° C., as described in JP-A-59-83154, JP-A-59-178451, JP-A-59-178452, JP-A-59-178453, JP-A-59-178454, JP-A-59-178455, JP-A-59-178457, and so forth. The amounts of the high boiling organic solvents used are 10 g or less, and preferably 5 g or less per g of a dye donating compound, and the amounts are preferably 1 cc or less, more preferably 0.5 cc or less, and most preferably 0.3 cc or less per g of a binder.

A process for dispersing the additives by use of polymers can also be used, which is described in JP-B-51-39853 and JP-A-51-59943. Besides the above-mentioned processes, the additives which are substantially water-insoluble compounds can be dispersed as finely divided powder into the binders.

To disperse the hydrophobic compounds in the hydrophilic colloids, various surfactants as described, for example, in JP-A-59-157636 (pp. 37 to 38) can be used.

Compounds which promote development and improve image stability at the same time can be used for the photosensitive material of the present invention. The compounds used preferably for this purpose are described in U.S. Pat. No. 4,500,626 (columns 51 to 52).

In the system of forming images by diffusive transfer of dyes, the dye fixing element is used together with the photosensitive material. The dye fixing element may be formed on a support different from that of the photosensitive material or may be formed on the same support as that of the photosensitive material. The relation between the photosensitive material and the dye fixing element, the relation with the support, and the relation with a white reflection layer and the element which are described in U.S. Pat. No. 4,500,626 (column 57) can also be applied to the present invention.

The dye fixing element used preferably in the present invention has at least one layer containing a mordant and a binder. Mordants known in the photographic field can be used in the present invention. Examples of the mordants are described in U.S. Pat. No. 4,500,626 (pp. 58 to 59), JP-A-61-88256 (pp. 32 to 41), JP-A-62-244043, JP-A-62-244036, and so forth. Further, dye accepting polymers as described in U.S. Pat. No. 4,463,079 may be used.

In the dye fixing element, auxiliary layers such as a protective layer, a peel layer, a curling prevention layer can be provided as needed. It is particularly useful to provide the protective layer.

For the constituent layers of the photosensitive material and the dye fixing element, high boiling organic solvents can be used as plasticizers, lubricants, or improvers for peeling the photosensitive material from the dye fixing element. Examples thereof are described in JP-A- 62-253159 (p. 25), JP-A-62-245253, and so forth. Further, for this purpose, various silicone oils can be used, which include all silicone oils from dimethylsilicone oil to modified silicone oils in which various organic groups are introduced into dimethylsiloxane. For example, various modified silicone oils described in technical material *Modified Silicone Oils* P6-18B published by Shin-Etsu Silicone Co., Ltd., particularly carboxy-modified silicone (trade name: X-22-3710) and the like, are efficient. Silicone oils described in JP-A-62-215953 and JP-A-63-46449 are also useful.

The photosensitive material and the dye fixing element can contain discoloration inhibitors which are, for example, antioxidants, ultraviolet absorbers, or some kinds of metal complexes. Examples of the antioxidants include chroman type compounds, coumaran type compounds, phenol type compounds (for example, hindered phenols), hydroquinone derivatives, hindered amine derivatives, and spiroindane type compounds. Further, compounds described in JP-A-61-159644 are also useful.

Examples of the ultraviolet absorbers include benzotriazole type compounds described in U.S. Pat. No. 3,533,794 and so forth, 4-thiazolidone type compounds described in U.S. Pat. No. 3,352,681 and so forth, benzophenone type compounds described in JP-A-46-2784 and so forth, and compounds described in JP-A-54-48535, JP-A-62-136641, JP-A-61-88256 and so forth. Ultraviolet absorbing polymers described in JP-A-62-260152 are also useful.

The metal complexes used as discoloration inhibitors are described in U.S. Pat. Nos. 4,241,155, 4,245,018 (columns 3 to 36), 4,254,195 (columns 3 to 8), JP-A-62-174741, JP-A-61-88256 (pp. 27 to 29), JP-A-63-199248, JP-A-1-75568, JP-A-1-74272, and so forth.

Examples of useful discoloration inhibitors are described in JP-A-62-215272 (pp. 125 to 137).

The discoloration inhibitors which are used to prevent the dye transferred to the dye fixing element from discoloration may be contained in the dye fixing element beforehand, or may be fed from an external material such as the photosensitive material to the dye fixing element.

The above-mentioned antioxidants, ultraviolet absorbers and metal complexes may be used in combination with one another.

Fluorescent whitening agents may be used for the photosensitive material and the dye fixing element. It is particularly preferred that the fluorescent whitening agents are incorporated into the dye fixing element or may be fed from an external material such as the photosensitive material. Examples of the fluorescent whitening agents used, which are described in *The Chemistry of Synthetic Dyes*, edited by K. Veenkataraman, vol. V, Chapter 8, JP-A-61-143752, and so forth, include stilbene type compounds, coumarin type compounds, biphenyl type compounds, benzoxazolyl type compounds, naphthalimide type compounds, pyrazoline type compounds, and carbostyril type compounds. The fluorescent whitening agents can be used in combination with the discoloration inhibitors.

Hardeners used for the constituent layers of the photosensitive material and the dye fixing element are those which are described in U.S. Pat. No. 4,678,739 (column 41), JP-A-59-116655, JP-A-62-245261, JP-A-61-18942 and so forth. Examples of the hardeners used in the present invention include aldehyde type hardeners (for example, formaldehyde), aziridine type hardeners, epoxy type hardeners, vinylsulfone type hardeners [for example, N,N'-ethylene-bis(vinylsulfonylacetamido)ethane], N-methylol type hardeners (for example, dimethylolurea), and high molecular hardeners (compounds described in JP-A-62-234157 and so forth). The vinylsulfone type hardeners described in JP-A-3-114043 are particularly preferably used.

To improve coating properties, peeling properties, sliding properties, and antistatic properties, and to promote development, various surfactants can be used for the constituent layers of the photosensitive material and the dye fixing element. Examples of the surfactants used are described in JP-A-62-173463, JP-A-62-183457, and so forth. To improve the sliding properties, the antistatic properties, and the peeling properties, organic fluorine compounds may be added to the constituent layers of the photosensitive material and the dye fixing element. Typical examples of the organic fluorine compounds used include fluorine type surfactants described in JP-B-57-9053 (columns 8 to 17), JP-A-61-20944, JP-A-62-135826, and so forth, and hydrophobic fluorine compounds such as oily fluorine type compounds (for example, fluorine oils) and solid fluororesins (for example, tetrafluoroethylene resins).

Matting agents can be used for the photosensitive material and the dye fixing element. The matting agents include silicon dioxide, compounds such as polyolefins and polymethacrylates described in JP-A-61-88256 (p. 29), and compounds such as benzoguanamine resin beads, polycarbonate resin beads and AS resin beads described in JP-A-63-274944 and JP-A-63-274952.

In addition, thermal solvents, defoaming agents, antifungal agents, colloidal silica, and so forth may be added to the constituent layers of the photosensitive material and the dye fixing element. Examples of these additives are described in JP-A-61-88256 (pp. 26 to 32). The antifungal agents used preferably are described in JP-A-3-11338.

In the present invention, image formation promoters can be used for the photosensitive material and/or the dye fixing element. The image formation promoters have a function to promote the redox reaction between the silver halide oxidizing agent and the reducing agent, a function to promote the reaction of dye formation or dye decomposition, or the reaction of releasing diffusive dyes from dye donating substances, and a function to promote dyes to transfer from the photosensitive material layer to the dye fixing layer. The image formation promoters are classified according to the physicochemical functions as follows: bases or precursors thereof, nucleophilic compounds, high boiling organic solvents (oils), thermal solvents, surfactants, and compounds having interaction with silver or silver ion. These substances have composite functions in general, and simultaneously have some of the above-mentioned effects of promotion. The substances are described in U.S. Pat. No. 4,678,739 (columns 38 to 40) in detail.

The precursors of bases include salts of organic acids and bases which are decarboxylated by heating, compounds releasing amines by undergoing an intramolecular nucleophilic displacement reaction, Lossen rearrangement, or Beckmann rearrangement, and so forth. Examples thereof are described in U.S. Pat. No. 4,511,493, JP-A-62-65038, and so forth.

In a system in which the heat development and the dye transfer are simultaneously carried out in the presence of a small amount of water, it is preferred that the bases or the precursors thereof are contained in the dye fixing element for keeping high storage properties of the photosensitive material.

Combination of sparingly water-soluble metallic compounds and compound which can react with the metallic ions constituting the sparingly water-soluble metallic compound to form complexes (referred to as "complex forming compounds") as described in European Patent Publication No. 210,660 and U.S. Pat. No. 4,740,445 are used in the present invention. Examples thereof are described in JP-A-2-269338 (pp. 2 to 6). Compounds used particularly preferably as the sparingly water-soluble metallic compounds are zinc hydroxide, zinc oxide, and mixtures of the both.

To steadily obtain constant images against changes in processing temperature on development and processing time, various development inhibitors can be used for the photosensitive material and/or the dye fixing element of the present invention. The development inhibitors herein mean compounds which rapidly neutralize the bases or react with the bases after finishing proper development to lower concentrations of the bases in the films, thus stopping the development, or compounds which control the development by mutual interaction with silver or silver salts. Examples of the development inhibitors used include acid precursors releasing acids by heating, electrophilic compounds undergoing a displacement reaction with the co-present base by heating, nitrogen-containing heterocyclic compounds, and mercapto compounds and precursors thereof. The above development inhibitors are described in JP-A-62-253159 (pp. 31 and 32) in more detail.

In the present invention, supports of the photosensitive material and the dye fixing element are required to have resistance to the processing temperature. In general, paper and synthetic polymers (films) are used as the supports. Examples of the supports used include poly(ethylene terephthalate), polycarbonates, poly(vinyl chloride), polystyrene, polypropylene, polyimides, celluloses (for example, triacetyl cellulose), products in which pigments such as titanium oxide are incorporated into these films, plastic film paper prepared from polypropylene or the like, paper made from a mixture of synthetic resin pulp such as polyethylene and natural pulp, Yankee paper, baryta-coated paper, coated paper (particularly, cast coat paper), metal, cloths, glass, and the like.

These supports can be used singly, or supports of which one surface or both surfaces are laminated with synthetic polymers such as polyethylene can also be used. In addition to these, supports described in JP-A-62-253159 (pp. 29 to 31) and supports described in JP-A-2-272543 and JP-A-222651 can be preferably used. Hydrophilic binders, semiconductive metal oxides such as alumina sol and tin oxide, and antistatic agents such as carbon black may be applied to the surfaces of these supports.

To record images in the photosensitive material by exposure, there are a method of directly shooting landscapes and human subjects by use of a camera, a method of conducting exposure through reversal films or negative films by use of a printer or an enlarger, a method of conducting scanning exposure of original pictures through the slit by use of an exposure unit of a duplicator, a method of conducting exposure by emitting light emission diodes or laser rays of various kinds via image data converted to electric signals, and a method of conducting exposure by output of image data on a display unit such as CRT, a liquid crystal display, an electroluminescence display, and a plasma display, directly or through an optical system.

As described above, light sources for recording images in the photosensitive material are natural light, a tungsten lamp, light emission diodes, laser ray sources, CRT sources, and the like, which are described in U.S. Pat. No. 4,500,626 (column 56). Further, image exposure can also be carried out with the aid of a wave changing element in which a non-linear optical material is combined with a coherent light source such as laser rays. The non-linear optical material herein means a material capable of developing non-linearity between polarization and an electric field which appears in a strong photoelectric field such as laser rays. Examples of the non-linear optical material used preferably include inorganic compounds such as lithium niobate, potassium dihydrogenphosphate (KDP), lithium iodate, and $BaB_2O_4$; and organic compounds such as urea derivatives, nitroaniline derivatives, nitropyridine-N-oxide derivatives such as 3-methyl-4-nitropyridine-N-oxide (POM), and compounds described in JP-A-61-53462 and JP-A-62-210432. Known forms of the wave changing element include a single crystal light wave guide type and a fiber type, both of which are useful.

Image signals obtained from video cameras, electronic still cameras, or the like, television signals typified by Japan Television Signal Standard (NTSC), image signals obtained by dividing an original picture into numerous pixels like a scanner, and image signals formed by use of a computer as typified by CG or CAD are utilized for the above-mentioned image data.

The photosensitive material and/or the dye fixing element of the present invention may contain an electrically-conductive heating element layer as a heating means for the heat development or the diffusive transfer of dyes. Transparent or opaque heating elements described in JP-A-61-145544 and so forth can be used for this purpose. The electrically-conductive layer functions also as an antistatic layer.

The heat development can be carried out at a temperature of about 50° to about 250° C., and particularly preferably at a temperature of about 80° to about 180° C. The diffusive transfer of dyes and the heat development may be conducted at the same time, or the diffusive transfer of dyes may be conducted after the heat development. In the latter case, the transfer of dyes can be carried out in the range of from the temperatures of heat development to room temperature, but more preferably at lower temperatures than the temperature of heat development carried out at 50° C. or higher by about 10° C.

Although the transfer of dyes is also possible merely by heating, solvents may be used to promote the transfer of dyes. Further, it is useful to conduct the heat development and the transfer, simultaneously or continuously, by heating in the presence of a small amount of a solvent (particularly water), as described in JP-A-59-218443, JP-A-61-238056, and so forth in detail. In this system, heating is preferably carried out at a temperature of from 50° C. to boiling points of the solvents. For example, when the solvent is water, a temperature of 50° to 100° C. is preferably applied.

Examples of the solvents used to promote the development and/or the transfer of diffusive dyes to the color fixing layer include water and basic aqueous solutions of inorganic alkaline metal salts and organic bases (The bases described above as the image formation promoters are used). Low boiling solvents, mixtures of low boiling solvents and water or basic aqueous solutions, or the like can also be used. Further, surfactants, antifoggants, or sparingly water-soluble metal salts and complex forming compounds may be contained in the solvents.

These solvents can be added to either or both of the dye fixing element and the photosensitive material. The amounts of the solvents added at highest are as small as weights of the solvents corresponding to the maximum swell volumes of total coated emulsions (weights or less after subtracting weights of the total coated films from weights of the solvents corresponding to the maximum swell volumes of the total coated films).

Methods for adding the solvents to the photosensitive layer or the dye fixing layer are described, for example, in JP-A-61-147244 (p. 26). The solvents microencapsulated can also be incorporated into either or both of the photosensitive material or the dye fixing element beforehand. Further, to promote the transfer of dyes, a system of incorporating hydrophilic thermal solvents which are solid at ordinary temperature but melt at a higher temperature into the photosensitive material or the dye fixing element can also be adopted. The hydrophilic thermal solvents may be incorporated into either or both of the photosensitive material and the dye fixing element. Layers into which the hydrophilic thermal solvents are incorporated may be any of the emulsion layers, the interlayers, the protective layer, and the dye fixing layer. However, they are preferably incorporated into the dye fixing layer and/or the layer next to the dye fixing layer. Examples of the hydrophilic thermal solvents include ureas, pyridines, amides, sulfonamides, imides, alcohols, oximes, and heterocyclic compounds.

To promote the transfer of dyes, high boiling organic solvents may also be contained in the photosensitive material and/or the dye fixing element.

In the development step and/or the transfer step, heating of the photosensitive material and the dye fixing element is conducted by bringing them into contact with a heated block or plate, a hot plate, a hot presser, a hot roller, a halogen lamp heater, or, an infrared or far infrared lamp heater, or by passing them through an atmosphere maintained at a high temperature. Conditions of pressure imposed on the photosensitive element superposed on the dye fixing element for their adhesion and methods for imposing the pressure are described in JP-A-61-147244 (p. 27).

The present invention is illustrated below with reference to examples. However, the present invention is not limited by the examples.

EXAMPLE 1

The same photosensitive material as photosensitive material 101 which was described in Example 1 of Japanese Patent Application No. 6-286122 was prepared and cut in 9 portions. The photosensitive materials cut were cooled or heated to 10°, 20°, 30°, 40°, 50°, 60°, 70°, 80°, and 90° C., respectively, and were subjected to scanning exposure from a slit through a test chart in which wedges of yellow, magenta, cyan, and gray having densities changing continuously were recorded, respectively. After an elapse of 5 seconds, the respective photosensitive materials exposed were dipped in water maintained at 40° C. for 2.5 seconds. Immediately after water was squeezed out by means of rollers, image receiving materials (image receiving material R101 described in Example 1 of Japanese Patent Application No. 6-286122) were superposed on the photosensitive materials so that the membranes of both the materials could be brought into contact, and subsequently, the superposed materials were heated for 17 seconds by use of a hot drum, the temperature of which was adjusted so as to be 80° C. at the membranes in which water was absorbed. The photosensitive materials were peeled from the image receiving materials, on which distinct color images corresponding to the original picture were formed.

Image densities in the same exposure amount to the respective exposure temperatures and results of inspection of fluctuations in density are shown in Table 1.

TABLE 1

| Temperature of Photosensitive Material on Exposure (°C.) | Density of Cyan | Fluctuation in Image Density |
|---|---|---|
| 10 | 0.70 | observed |
| 20 | 0.76 | observed |
| 30 | 0.81 | observed |
| 40 | 0.84 | not observed |
| 50 | 0.84 | not observed |
| 60 | 0.85 | not observed |
| 70 | 0.85 | not observed |
| 80 | 0.85 | not observed |
| 90 | 0.85 | not observed |

The results of Table 1 show that, when the exposure temperature are in the range of 40° to 90° C., the changes in density are small and the fluctuations in image also are not observed.

EXAMPLE 2

The same photosensitive material as photosensitive material 101 described in Example of JP-A-8-62807 was prepared and cut in 9 portions. The photosensitive materials cut were cooled or heated to 10°, 20°, 30°, 40°, 50°, 60°, 70°, 80°, and 90° C., respectively, and were subjected to scanning exposure from a slit through a test chart in which wedges of yellow, magenta, cyan, and gray having densities changing continuously were recorded, respectively. After an elapse of 5 seconds, the respective the photosensitive materials exposed were dipped in water maintained at 40° C. for 2.5 seconds. Immediately after water was squeezed out by use of rollers, the photosensitive materials were superposed on image receiving materials (image receiving material R201 described in Example of JP-A-8-62807) so that the membranes of both the materials could be brought into contact, and subsequently, the superposed materials were heated for 30 seconds by use of a heat drum, the temperature of which was adjusted so as to be 80° C. at the membranes in which water was absorbed. The photosensitive materials were peeled from the image receiving materials, on which distinct color images corresponding to the original picture were formed.

Image densities in the same exposure amount to the respective exposure temperature, and results of inspection of fluctuations in density are shown in Table 2.

TABLE 2

| Temperature of Photosensitive Material on Exposure (°C.) | Density of Cyan | Fluctuation in Image Density |
|---|---|---|
| 10 | 0.70 | observed |
| 20 | 0.75 | observed |
| 30 | 0.80 | observed |
| 40 | 0.83 | not observed |
| 50 | 0.83 | not observed |
| 60 | 0.83 | not observed |
| 70 | 0.84 | not observed |
| 80 | 0.84 | not observed |
| 90 | 0.84 | not observed |

Similarly to Example 1, the results of Table 2 show that, when the exposure temperatures are in the range of 40° to 90° C., the changes in density are small and the fluctuations in density also are not observed. When exposure is conducted at temperatures of higher than 90° C., the photosensitive element was unable to be transported and processing thereof was impossible, because of its too large curling.

While the invention has been described in detail and with reference to specific embodiments thereof, it will be apparent to one skilled in the art that various changes and modifications can be made therein without departing from the spirit and scope thereof.

What is claimed is:

1. An image formation process comprising image exposing a photosensitive element which contains at least a photosensitive silver halide, a binder and a dye donating compound which forms or releases a diffusive dye corresponding or inversely corresponding to an exposure amount, and then transferring the diffusive dye formed or released to a dye fixing element by heat development in the presence of, as a base precursor, a sparingly water-soluble metallic compound and a compound which can react with the metallic ion constituting the sparingly water-soluble metallic compound to form a complex in water as a medium, wherein said process further comprises the step of feeding water to said photosensitive element after image exposure, and the photosensitive element is maintained at a temperature of 40° to 90° C. on undergoing exposure.

2. The image formation process as claimed in claim 1, wherein said step of feeding water is conducted within 5 minutes after heating on undergoing exposure.

3. The image formation process as claimed in claim 1, wherein said step of feeding water is conducted within 1 minute after heating on undergoing exposure.

* * * * *